US005128021A

United States Patent [19]

Romey et al.

[11] Patent Number: 5,128,021

[45] Date of Patent: Jul. 7, 1992

[54] PITCH FROM COAL TAR PITCH, METHOD OF ITS PRODUCTION, AS WELL AS APPLICATION OF SUCH PITCH MATERIAL

[75] Inventors: Ingo Romey, Hunxe; Rudolf Geier, Essen; Rolf H. Joest, Duisburg; Wilhelm Wüllscheidt, Bottrop, all of Fed. Rep. of Germany

[73] Assignees: Bergwerksverband GmbH; Didier Engineering GmbH, both of Essen, Fed. Rep. of Germany

[21] Appl. No.: 397,486

[22] PCT Filed: Jan. 16, 1988

[86] PCT No.: PCT/EP88/00031

§ 371 Date: Aug. 3, 1989

§ 102(e) Date: Aug. 3, 1989

[87] PCT Pub. No.: WO88/05806

PCT Pub. Date: Aug. 11, 1988

[30] Foreign Application Priority Data

Jan. 30, 1987 [DE] Fed. Rep. of Germany ..... 3702720

[51] Int. Cl.[5] ..... C10G 1/00; C10C 3/00

[52] U.S. Cl. ..... 208/39; 208/22; 208/42; 208/44

[58] Field of Search ..... 208/22, 39

[56] References Cited

U.S. PATENT DOCUMENTS

| | | | |
|---|---|---|---|
| 2,956,944 | 10/1960 | Logan et al. | 208/39 |
| 3,190,812 | 6/1965 | Puls | 196/107 |
| 3,928,169 | 12/1975 | Conroy | 208/22 |
| 4,036,603 | 7/1977 | Bernet et al. | 208/39 |
| 4,046,690 | 9/1977 | Rodgers et al. | 210/75 |
| 4,243,512 | 1/1981 | Seo | 208/22 |
| 4,277,324 | 7/1981 | Greenwood | 208/39 |
| 4,320,107 | 3/1982 | Oyabu et al. | 423/447.6 |
| 4,436,615 | 3/1984 | Boodman et al. | 208/39 |
| 4,448,670 | 5/1984 | Dickakian | 208/22 |
| 4,497,789 | 2/1985 | Sawran et al. | 208/22 |
| 4,517,072 | 5/1985 | Cukier et al. | 208/22 |
| 4,522,701 | 6/1985 | Dickakian | 208/22 |
| 4,575,411 | 3/1986 | Uemura | 208/39 |
| 4,604,184 | 8/1986 | Cukier et al. | 208/39 |
| 4,874,502 | 10/1989 | Tsuchitani et al. | 208/22 |

FOREIGN PATENT DOCUMENTS

| | | |
|---|---|---|
| 0084237 | 7/1983 | European Pat. Off. . |
| 850880 | 10/1960 | United Kingdom . |
| 206885 | 2/1980 | United Kingdom . |
| 8602952 | 5/1986 | World Int. Prop. O. . |

*Primary Examiner*—Helane Myers
*Attorney, Agent, or Firm*—Herbert Dubno

[57] ABSTRACT

A novel pitch material made from coal tar pitch has:

a) mesophase content of ≦2%, b) content of toluene-insolubles (β-resin) between 58 and 75%, c) content of quinoline-insolubles of <2%, d) softening point in the 200° to 300° C. range, according to the Krämer-Sarnow (KS) measurement, e) content of volatile matter ≦20% and f) ash content of ≦0.06%.

The pitch material of high coke yield (80 to beyond 90%) is suitable for the manufacture of molded carbonaceous shapes of high quality and of pitch coke. A further application would be as impregnation agent or bind. The method of making new pitch uses hot filtration in the presence of a filtration and followed by thin-film evaporation.

5 Claims, 2 Drawing Sheets

VISCOSITY OF HARDPITCH-SAMPLES
IN DEPENDENCE OF TEMPERATURE
MEASURED WITH A SHEAR GRADIENT OF 5/SEC

PITCH FROM COAL TAR PITCH, METHOD OF ITS PRODUCTION, AS WELL AS APPLICATION OF SUCH PITCH MATERIAL

CROSS REFERENCE TO RELATED APPLICATIONS

This application is a national phase of PCT/EP88/00031 filed Jan. 16, 1988 and based upon German national application P 37 02 720.4 filed Jan. 30, 1987 under the International Convention.

FIELD OF THE INVENTION

The present invention relates to a pitch material made from coal tar pitch, to a method of producing the pitch and to different applications of such pitch.

BACKGROUND OF THE INVENTION

In the previous state of the art coal tar pitch has been treated e.g. by distillation, solvents, air blowing or cross-linking reactions in order to give a pitch material having a softening point between 70° to 150° C. Such pitch material serves as a binder for high-grade carbonaceous products, e.g. electrodes, carbon brushes and the like as well as molded shapes of high mechanical strength which—after subsequent thermal treatment of the carbonized material—are appropriate for manufacturing graphites. One drawback is, however, that the molded shapes obtained from the previous type of pitch material after an initial thermal treatment step are of relatively low density and have to be subjected to several impregnation treatments and recarbonizations to improve this density.

OBJECT OF THE INVENTION

The objective of the invention is to provide a pitch material which can be made from coal tar pitch and a method of producing same, with a view to manufacturing high-grade carbonaceous products without the necessity of additional treatment steps—or at least requiring fewer treatment steps than with the previous state of the art—the improved pitch material being moreover suitable for use as an impregnation agent and, finally, as a high-grade binder.

SUMMARY OF THE INVENTION

This object is achieved with a coal tar pitch-based material characterized by the following parameters:

a) mesophase content of $\leqq 2\%$.

b) content of toluene-insolubles ($\beta$-resins) between 58 and 75%, c) content of quinoline-insolubles of $\leqq 2\%$, d) softening point in the 200° to 300° C. range, according to the Krämer-Sarnow (KS) measurement, e) content of volatile matter $\leqq 20\%$ and f) ash content of $\leqq 0.06\%$.

Thanks to the surprisingly high softening point (for a coal tar pitch) in the range from 200° to 300° C. (KS) the material exhibits excellent treatment properties with no risk whatsoever of premature carbonization or thermal degradation.

The new pitch material surprisingly yields quite a high amount of coke, too,—between 80 to >90%—which is an extremely favorable feature for pitch material from coal tar pitch since it gives a coke of higher density and, if further treated, also a denser graphite, all of those treatments using fewer treatment steps and shorter retention times than previously.

The novel-type pitch material is produced by a sequence of steps wherein

A) as starting material is used a coal tar pitch containing between 1 and 10% solids, e.g. ash, coal particles, quinoline-insolubles (primary $\alpha$-resins), and exhibiting a softening points of <100° C. is used as the starting material, B) between 1 to 10% filtering agents—e.g. diatomite, activated carbon or similar—is added to the starting material, C) the mixture is subjected to hot filtration in a candle filter discharging a dry filter cake and exhibiting gaps sized between 50 to 150 $\mu$m and D) the filtrate is subjected to concentration in a thin-layer evaporator in the temperature range from above 300° C. to about 425° C. and at $\leqq 10$ mbar pressure.

The pitch material can be produced from the usual type of coal tar pitch whose softening point is below 100° C. and which may contain between 1 and 10% solids, by freeing the starting material from most of its solids (which may be constituted of ash, coal particles and quinoline-insolubles (primary $\beta$-resins)) in a candle filter where, as the case may be, filtration agents are added. The thus pre-purified pitch is, surprisingly, suitable for smooth transformation into the novel-type pitch material in thin-layer evaporators at a vacuum of $\leqq 10$ mbar and at above 300° C. The pitch material is obtained as a concentrate.

Another striking feature is that the by-products cracked in the form of distillates have excellent features which make them especially suitable for use as an aggregate to tars, pitches and oils.

Alternatively, process feature C) (filtration) may be varied in that a disk filter with a secondary treatment step is used.

Another variant of process feature C) (filtration) is that a drum filter for dry cake discharge is used.

When opting for the two aforementioned alternative filtration steps, adequate volumes of particle-free filtrates are obtained and can be subject to treatment in the thin-layer evaporator.

The novel-type pitch material is appropriate for manufacturing carbonaceous products since it possesses excellent treatment properties.

One preferred application is the manufacture of pitch coke since the coke yield—more than 90%—is surprisingly high.

Another preferred application is the manufacturing of molded carbonaceous shapes which are suitable for example, for producing electrodes, carbon brushes or the like. In a graphitic state the thermally treated product represents an excellent reactor graphite.

Still another preferred application of the novel pitch material is as an impregnation agent since the former, surprisingly, is of an extraordinarily favorable dynamic viscosity as a function of temperature. This impacts to molded carbonaceous shapes made from pitch material high mechanical strength even with a few impregnation steps.

The new pitch material finally is an excellent binder for carbonaceous material.

BRIEF DESCRIPTION OF THE DRAWING

The above and other objects, features and advantages of the present invention will become more readily apparent from the following description, reference being made to the accompanying drawing in which.

SPECIFIC DESCRIPTION AND EXAMPLES

Figure 1:
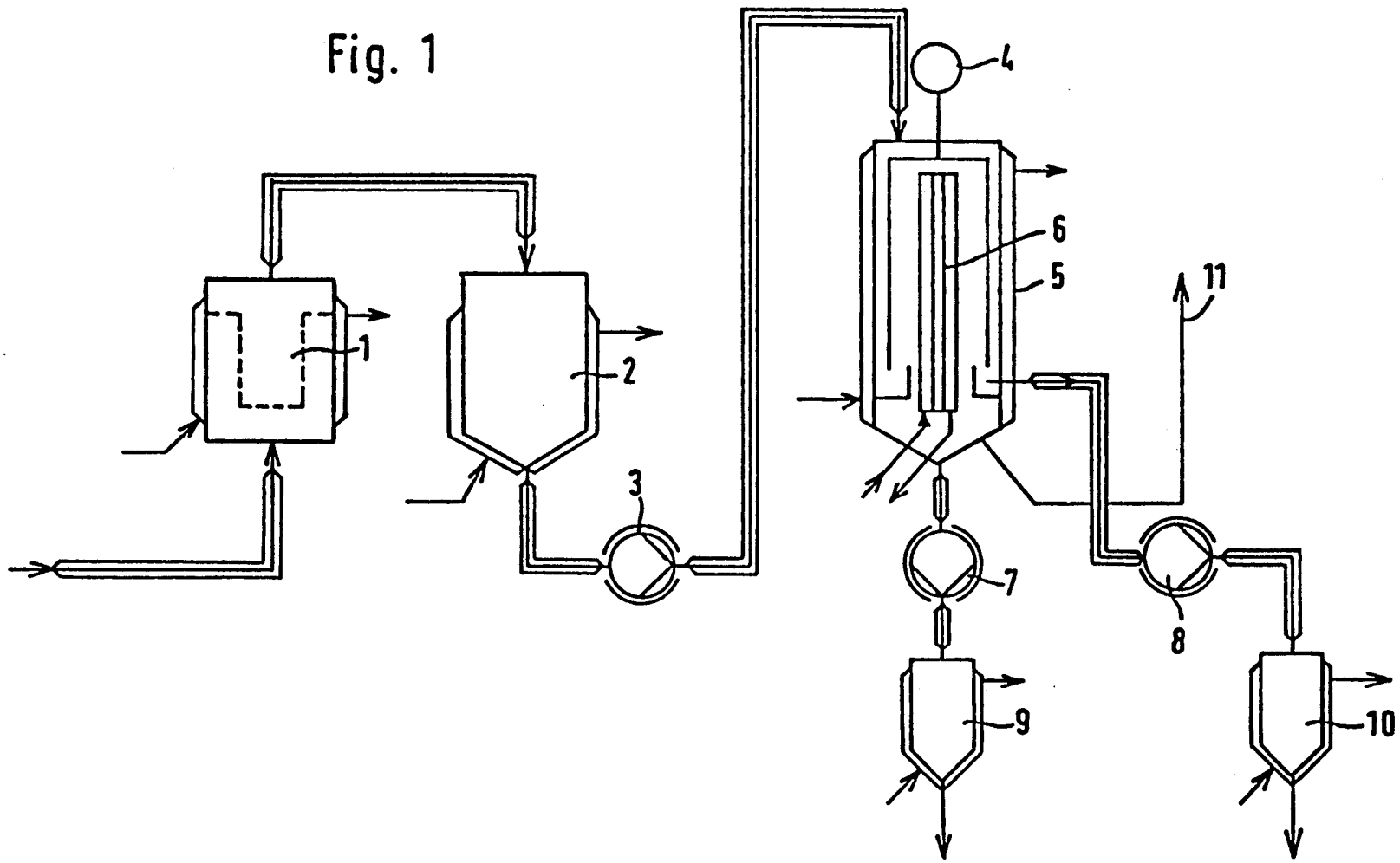
FIG. 1 is a flow diagram illustrating the method of the invention.

The hardcoal raw tar or hardcoal raw pitch is after addition of a filtration agent, feed to the hot filtration step 1 (FIG. 1) consisting either of a candle filter for dry filter cake discharge of a disk filter including a secondary treatment device. Depending on the initial product the filtration temperature will be comprised between 90° to 350° C. The filtered product then passes to a storage tank 2 whence it is pumped (by supply pump 3) to a thin-layer evaporator 5 whose impeller is connected to a drive unit 4. The impeller ensures even spreading of the product over the interior wall of the evaporator so that the more easily volatile constituents will evaporate quite fast. The evaporator 5 also includes a condenser 6 in which the easily volatile constituents of the filtrated material will precipitate. These constituents then drop to the bottom of the thin-layer evaporator 5 whence they are withdrawn by distillate discharge pump 7 to enter distillate reserve tank 9. Operational temperatures in the evaporator are above 300° C., whereas the operational pressure either stays below 10 mbar or is equal to it. The non-evaporated product portion (concentrate) then enters the intake side of the concentrate discharge pump 8, to be withdrawn from the evaporator 5 and collected in the concentrate reserve tank 10. The vacuum in that tank is drawn by means of the vacuum system 11.

The concentrate may be used e.g. as a raw material for the production of high-grade pitch coke and pitch graphite, as a foundry pitch, impregnation pitch for pitch cokes, binder for molded carbonaceous shapes or, finally, a pitch for clay pigeons.

The distillate can be fractionated in the usual way and is suitable e.g. for the following applications:

as an admixture to tars, especially to particle-containing tars;

as an admixture to pitches (fluxing agent); and as admixtures to oils.

The following sections contain three examples of pitch materials from carbonaceous pitches produced according to the invention and where each of the carbonaceous pitches was liberated from its insolubles by filtration and thereafter underwent distillation at increased temperature and reduced pressure in order to get rid of the low softening point fractions and obtain a pitch concentrate of higher softening point. The initial pitches are, in general, those having a softening point <100° C. (KS) even though in principle pitches of a higher softening range may be used as well, although with the latter the attainable filtration result will deteriorate.

EXAMPLE 1

A hardcoal tar pitch of a softening point of 69° C., containing 6.9% of quinoline-insolubles, was heated to 240° C. and filtered in a candle filter at a steadily rising differential pressure between 1 and 5 bar. The filtration yield may be improved by adding, as the case may be, approx. between 1 to 4% of diatomite-, celite- or carbon-based filtering agent. After filtration practically all of the quinoline-insolubles were found to have been removed below the detectability limit. The material could, thereafter, be fed without any further pretreatment to a thin-layer evaporator.

The filtered soft pitch material whose softening point was at 69° C. was subjected to a continuous single-step thermal treatment at 328° C. and 1 mbar operational pressure. During such treatment mechanically driven wiper blades were used to distribute the pitch in the evaporator and control its flow direction. All the while the material was subjected to mechanical self-cleaning. The operational vacuum was created by vacuum generating devices, a multistage vacuum system being preferred.

Average residence time of the pitch material in the evaporator was less than 1 min. The fraction yielded by distillation were removed via a condenser incorporated in the evaporator and thence discharged.

The specific evaporator throughput was as high as 80.0 kg/(m$^2$.h) and the concentrate was 49.6% by wt. The final concentrate had a softening point (KS) of 209° C.

The remaining specific material properties of the concentrate at 209° C. softening point were:

carbonization residue (Alcan): 81.5% secondary insolubles: 0.14%

Figure 2:
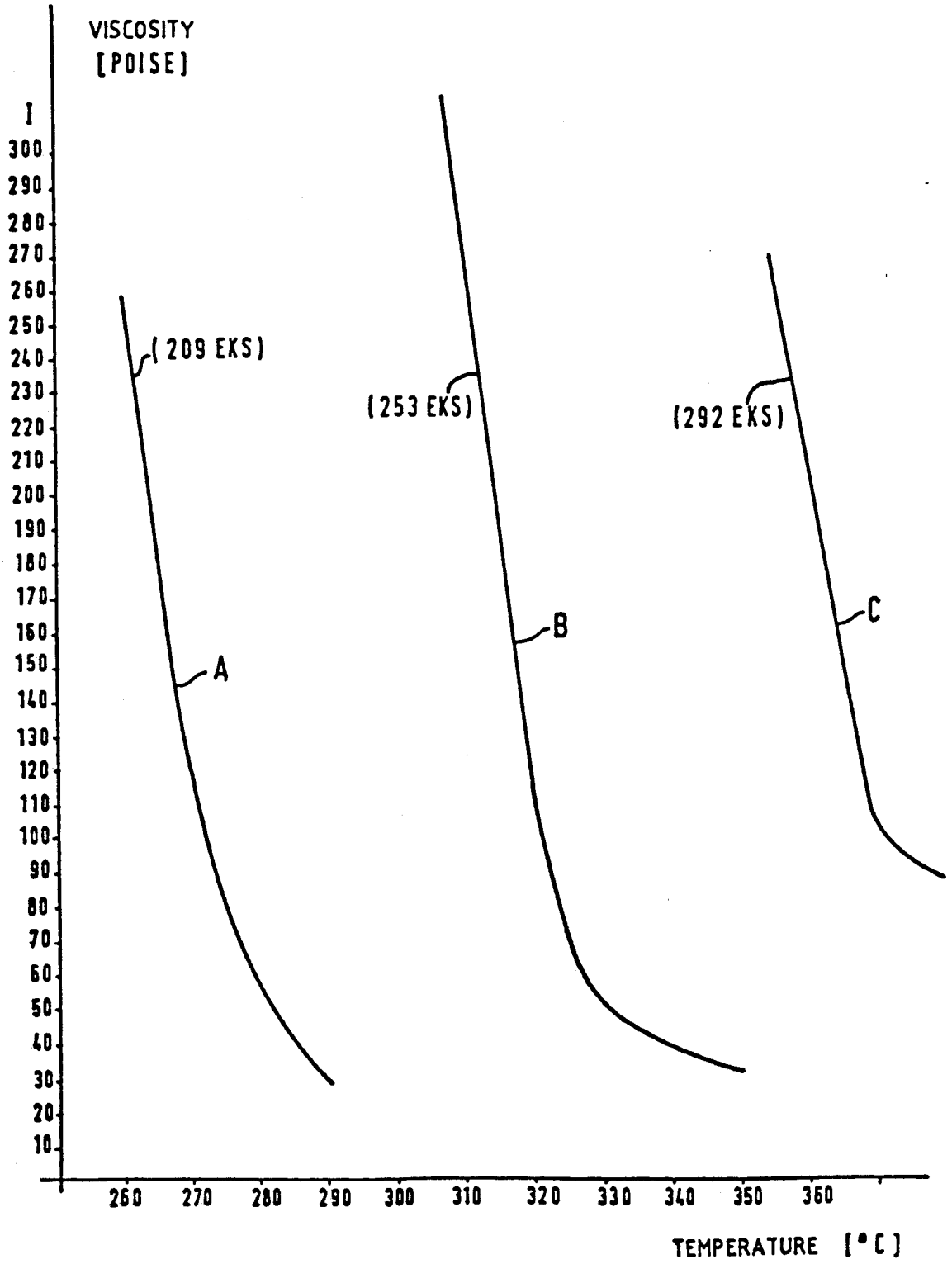
FIG. 2 is a graph illustrating the examples.

$\beta$-resins: 58% quinoline-insolubles: 0.78% dynamic viscosity as a function of temperature (see curve A of FIG. 2)

volatiles 18.5% mineral matter 0.05%

EXAMPLE 2

The initial pitch material and experimental set-up were identical to those in Example 1, whereas the temperature of the thermal treatment was increased at 361° C.

The specific throughput was 73.4 kg/(m$^2$.h). The yield amounted to 33.7% by wt.; the concentrate had a softening point of 253° C.

The remaining specific material properties were:

carbonization residue (Alcan): 86.2% secondary insolubles: 0.9%

$\beta$-resins: 69% quinoline-insolubles: 1.55% dynamic viscosity as a function of temperature (see curve B of FIG. 2)

volatiles 13,8% mineral matter 0.06%

EXAMPLE 3

Here, again, the initial pitch material and experimental set-up were identical to those in Example 1 whereas this time the temperature was increased to 395° C.

The specific throughput was 70.8 kg/(m$^2$.h). The yield amounted to 27.6% by wt. and the softening point of the concentrate was 292° C.

The remaining specific material properties were:

carbonization residue (Alcan): 90.8% secondary insolubles: 1.01%

$\beta$-resins: 75% quinoline-insolubles: 1.95% dynamic viscosity as a function of temperature (see curve C of FIG. 2)

volatiles 9.2% mineral matter 0.06%

We claim:

1. A pitch material made from coal tar pitch and having:

(a) a mesophase content up to 2%;
(b) a toluene-insoluble β-resin content between 58 and 75%;
(c) a quinoline-insolubles content up to 2%;
(d) a Krämer-Sarnow softening point of 200° to 300° C.;
(e) a volatile matter content up to 20%; and
(f) an ash content up to 0.06%.

2. A method of making a pitch material having:
(a) a mesophase content up to 2%;
(b) a toluene-insoluble β-resin content between 58 and 75%;
(c) a quinoline-insolubles content up to 2%;
(d) a Krämer-Sarnow softening point of 200° to 300° C.;
(e) a volatile matter content up to 20%; and
(f) an ash content up to 0.06%, said method consisting of the steps of:
(A) adding to a coal tar pitch containing 1 to 10% solids as ash, coal particles and quinoline insolubles, and having a softening point of at least most 100° C., between 1% of a filtering agent selected from the group which consists of diatomite and activated carbon to form a filterable mixture;
(B) subjecting said filterable mixture to hot filtration on a filter having openings of a size between 50 and 150 micrometers to produce a filtrate and a dry filter cake; and
(C) concentrating said filtrate in a thin-film evaporator at a temperature of 300° C. to 425° C. and a pressure of at most 10 mbar, thereby forming a concentrate and a condensate, said concentrate constituting said pitch material.

3. The method defined in claim 2 wherein said filterable mixture is subjected to hot filtration on a candle filter.

4. The method defined in claim 2 wherein said filterable mixture is subjected to hot filtration on a disk filter.

5. The method defined in claim 2 wherein said filterable mixture is subjected to hot filtration on a drum filter.

* * * * *